US009406491B2

(12) United States Patent
Wood

(10) Patent No.: US 9,406,491 B2
(45) Date of Patent: Aug. 2, 2016

(54) MULTIPLE IONIZATION SOURCES FOR A MASS SPECTROMETER

(71) Applicant: Lockheed Martin Corporation, Bethesda, MD (US)

(72) Inventor: John Arthur Wood, Bethlehem, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 14/664,375

(22) Filed: Mar. 20, 2015

(65) Prior Publication Data

US 2015/0270111 A1 Sep. 24, 2015

Related U.S. Application Data

(60) Provisional application No. 61/968,045, filed on Mar. 20, 2014.

(51) Int. Cl.

| | |
|---|---|
| ***H01J 49/26*** | (2006.01) |
| ***H01J 49/10*** | (2006.01) |
| ***H01J 49/16*** | (2006.01) |
| ***H01J 49/42*** | (2006.01) |
| ***H01J 49/24*** | (2006.01) |

(52) U.S. Cl.

CPC ..... *H01J 49/107* (2013.01); *H01J 49/161* (2013.01); *H01J 49/168* (2013.01); *H01J 49/24* (2013.01); *H01J 49/42* (2013.01)

(58) Field of Classification Search

USPC ..... 250/281, 282, 283, 288

See application file for complete search history.

(56) References Cited

U.S. PATENT DOCUMENTS

| | | | | |
|---|---|---|---|---|
| 6,326,615 | B1 | 12/2001 | Syage et al. | |
| 6,750,449 | B2 | 6/2004 | Marcus | |
| 7,196,325 | B2 | 3/2007 | Syage | |
| 2004/0232326 | A1 * | 11/2004 | Guevremont et al. | 250/287 |
| 2005/0056776 | A1 | 3/2005 | Willoughby et al. | |
| 2006/0255261 | A1 * | 11/2006 | Whitehouse | H01J 49/0431 250/288 |
| 2006/0284103 | A1 | 12/2006 | Syage | |
| 2009/0127453 | A1 | 5/2009 | Ding et al. | |
| 2010/0096546 | A1 | 4/2010 | Ewing et al. | |
| 2011/0036977 | A1 | 2/2011 | Denton et al. | |

* cited by examiner

*Primary Examiner* — Nicole Ippolito

(74) *Attorney, Agent, or Firm* — Oblon, McClelland, Maier & Neustadt, L.L.P.

(57) ABSTRACT

Systems and methods for a mass spectrometer include an atmospheric-pressure chemical ionization (APCI) source, one or more low-pressure chemical ionization (LPCI) sources, a mass analyzer configured to separate ions of a sample flow from the APCI source and the one or more LPCI sources, a detector configured to identify and quantify the received separated ions, and a plurality of valves configured to open and close associated input lines to the APCI source and the one or more LPCI sources, via a computer-implemented controller, and configured to maintain a vacuum environment of the mass spectrometer during the opening and closing.

20 Claims, 6 Drawing Sheets

Fig. 2A
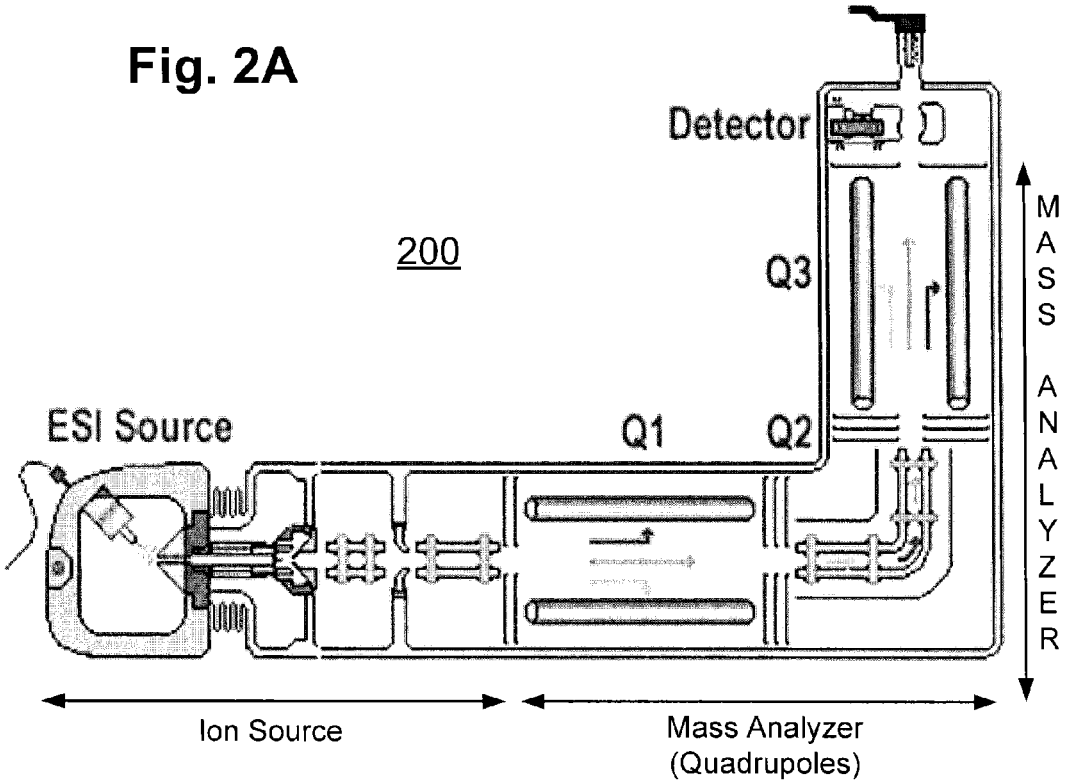
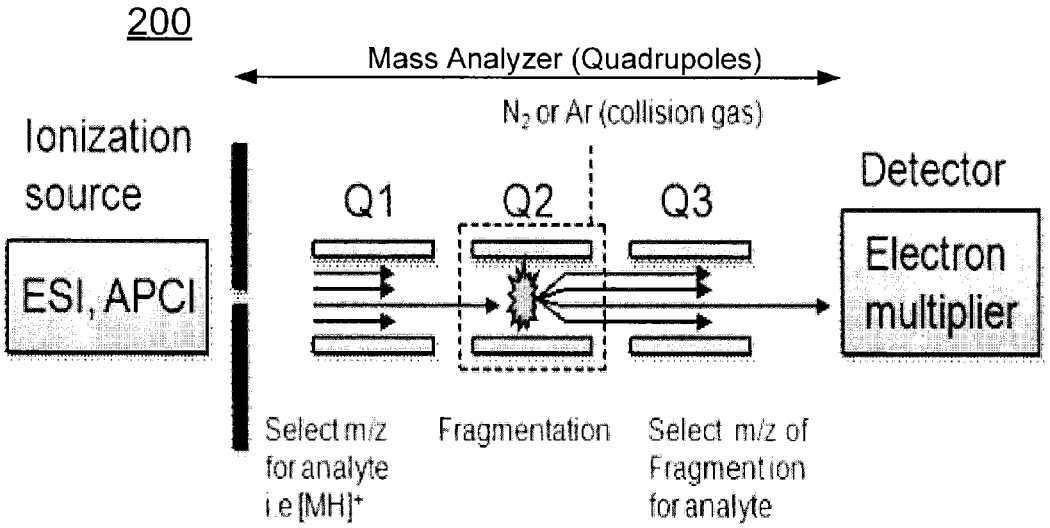
Fig. 2B

600

MULTIPLE IONIZATION SOURCES FOR A MASS SPECTROMETER

CROSS-REFERENCE TO RELATED APPLICATION

This application claims the benefit of U.S. Provisional Application No. 61/968,045, filed on Mar. 20, 2014, the disclosure of which is incorporated in its entirety by reference herein.

BACKGROUND

Mass spectrometry identifies the amount and type of chemicals present in a sample by ionizing the gas flow or vapor flow, separating resulting fragmented ionized components, and measuring the abundance of each type of ionized component. Several ionization techniques and ionization sources are available. A particular technique and ionization source are selected based in part, upon the nature of the sample flow. As a result, a mass spectrometer frequently needs to be reconfigured to accommodate a different ionization source.

The mass analyzer and detector regions of the mass spectrometer are sealed under a high vacuum. This high vacuum needs to be broken each time an ionization source is changed. Therefore, a great deal of time is required to change over to another ionization source and to provide a new vacuum environment within the mass spectrometer.

SUMMARY

Aspects of the disclosure include methods and systems for multiple ionization sources for a mass spectrometer. Ionization sources include low-pressure chemical ionization (LPCI) and atmospheric-pressure chemical ionization (APCI) sources.

Embodiments include a mass spectrometer having an APCI source, and one or more LPCI sources. The mass spectrometer also includes a mass analyzer configured to separate ions of a sample flow from the APCI source and the one or more LPCI sources, and a detector configured to identify and quantify the received separated ions. The mass spectrometer also includes a plurality of valves configured to open and close associated input lines to the APCI source and the one or more LPCI sources, via a computer-implemented controller, and configured to maintain a vacuum environment of the mass spectrometer during the opening and closing.

Embodiments include a method of chemically analyzing a sample flow, wherein the method includes receiving a first air input sample flow via a LPCI input line, and ionizing the first air input sample flow. The method also includes closing one or more LPCI input line valves and opening one or more APCI input line valves, and receiving a second air input sample flow via an APCI input line. The method also includes ionizing the second air input sample flow, wherein a vacuum chamber environment is maintained throughout the method.

Embodiments include a mass spectrometer, which includes an APCI source input line, and a LPCI sample flow air inlet line. The mass spectrometer also includes a LPCI reactant gas inlet line, a glow discharge LPCI source, and a photoionization LPCI source. The mass spectrometer also includes a mass analyzer, a detector, and a plurality of computer-actuated valves configured to open and close the APCI source input line, the LPCI sample flow air inlet line, and the LPCI reactant gas inlet line while maintaining a vacuum environment of the mass spectrometer during the opening and closing.

BRIEF DESCRIPTION OF THE DRAWINGS

Various exemplary embodiments will be described in detail with reference to the following figures, wherein:

FIG. 2A is a pictorial layout of an exemplary triple quadrupole mass spectrometer according to an embodiment;

FIG. 2B is an illustration of the stages of ion travel through the quadrupoles of a mass analyzer region of mass spectrometer according to an embodiment;

The foregoing paragraphs have been provided by way of general introduction, and are not intended to limit the scope of the following claims. The described embodiments will be best understood by reference to the following detailed description taken in conjunction with the accompanying drawings.

DETAILED DESCRIPTION

Mass spectrometry is an analytical chemistry technique of identifying the amount and type of chemicals present in a sample flow. The sample flow may include a gas or a vaporized liquid stream emanating from a chromatographic column that has separated substances from a discrete sample. The sample flow can include a continuous flow of gas from a monitored location, providing near real-time data on changing concentrations of target substances in the flow stream. A mass spectrum is a plot of the ion signal as a function of the mass-to-charge ratio. The spectra are used to determine the elemental or isotopic signature of a sample flow and the masses of particles and of molecules. Mass spectrometry works by ionizing chemical compounds to generate charged molecules or molecule fragments and measuring the abundance of each group according to their mass-to-charge ratios.

The disclosure herein describes multiple ionization sources for a mass spectrometer and in particular, for a triple quadrupole mass spectrometer. Embodiments described herein provide systems that can switch between multiple ionization sources without reconfiguration or setup of those ionization sources and without breaking an existing vacuum. Therefore, analyzing multiple target substances can be achieved quickly, even when some of the target substances require using different ionization sources.

Embodiments described herein provide attachment of a LPCI source to the end of an APCI source, while maintaining the functionality of both ionization sources. A low pressure photoionization source and a low pressure glow discharge source are also configured with the mass spectrometer. A combination of compatible hardware components, ion lenses, and electrically-actuated low pressure gas valves controlled by a computer processing device provide instant access to multiple ionization sources in the mass spectrometer. Embodiments of a multiple ionization-source mass spectrometer provide advantages in several fields, including law enforcement, homeland security, transportation security, medicine, food process control, and environmental protection.

Figure 1A:
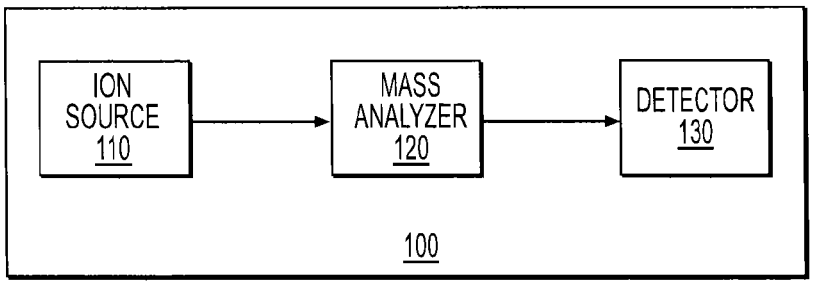
FIG. 1A is a block diagram illustrating major components of a mass spectrometer according to an embodiment.

FIG. 1A is a block diagram illustrating the three major components of a mass spectrometer 100. An ion source 110 converts a portion of the sample flow into ions. There are a wide variety of ionization techniques, which depend upon the solid, liquid, or gas phase of the sample flow and depend upon the composition of the sample flow. An extraction system removes ions from the sample flow, which are targeted through a mass analyzer 120. The mass analyzer 120 sorts the ions based on the charge and the differences in mass of the fragments in a mass-to-charge ratio. A detector 130 measures the value of an indicator quantity of each sorted ion group to provide data for calculating the abundance of each ion present.

Figure 1B:
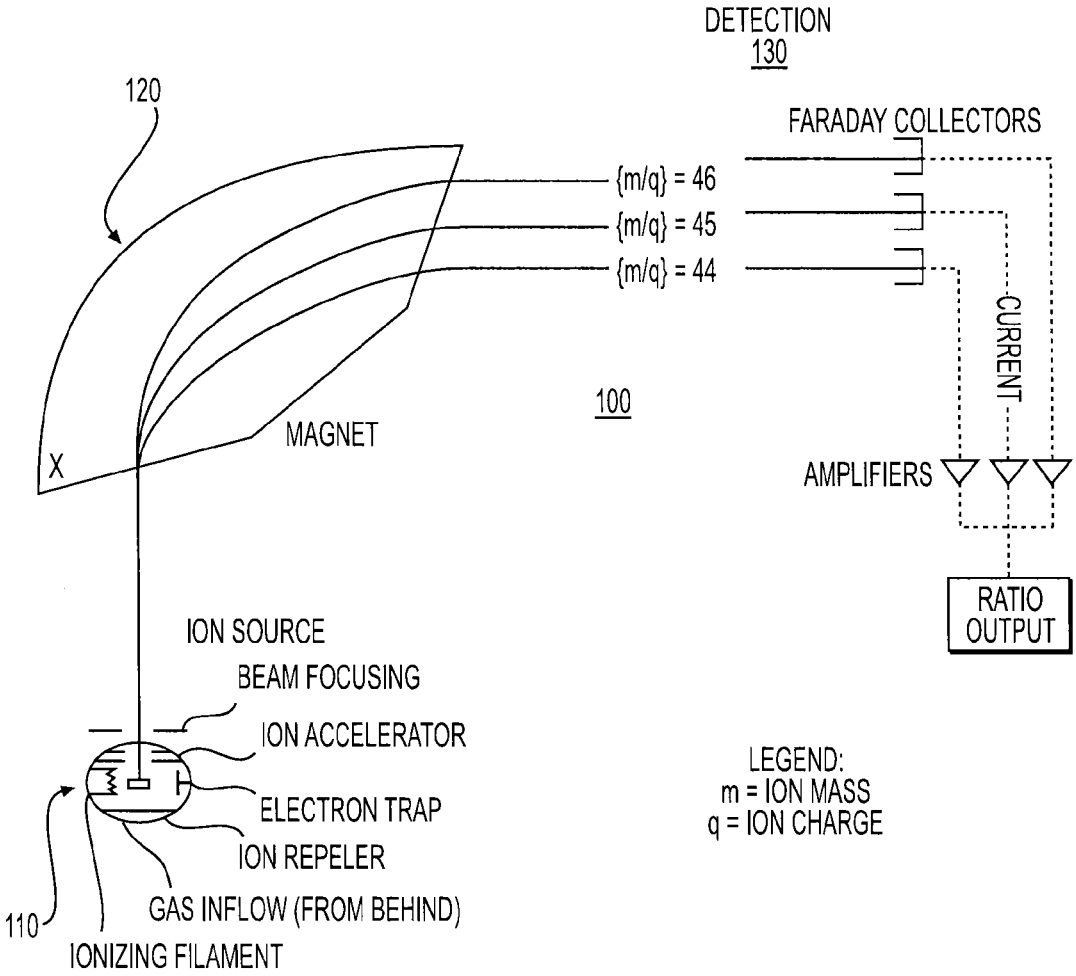
FIG. 1B is a pictorial illustration of a mass spectrometer according to an embodiment.

FIG. 1B is a pictorial illustration of a mass spectrometer 100. A sample flow material (also called an analyte) is ionized in ion source 110. Several techniques are available for ionization. The technique selected is determined in part, by the sample flow material being ionized. Electron ionization and chemical ionization techniques can be used for gases and vapors. In chemical ionization, the analyte is ionized by chemical ion-molecule reactions during collisions in the ion source 110. Techniques used with liquid and solid biological samples include electrospray ionization and matrix-assisted laser desorption/ionization. Other ionization techniques include inductively coupled plasma, photoionization, glow discharge, field desorption, fast atom bombardment, thermospray, desorption/ionization on silicon, Direct Analysis in Real Time, APCI, secondary ion mass spectrometry, spark ionization, and thermal ionization.

Mass analyzer 120 separates the ions received from the ion source region according to their mass-to-charge ratios. Mass analyzer 120 contains electric and magnetic fields, which exert forces on the ions traveling through the fields. The speed of a charged particle may be increased or decreased while passing through the electric field, and its direction may be altered by the magnetic field. The magnitude of the deflection of the moving ion's trajectory depends on its mass-to-charge ratio. Lighter ions get deflected by the magnetic force more than heavier ions. As illustrated in FIG. 1B, ions having a m/q (mass-to-charge ratio) of 44 are deflected more than ions having a m/q of 45 or 46.

The streams of sorted ions leave the mass analyzer 120 and are directed towards a detector 130, which records the relative abundance of each ion type. This information is used to determine the chemical elemental composition of the original sample flow. The detector 130 records either the charge induced or the current produced when an ion passes by or hits a surface. The signal produced in the detector during the course of a sample flow scan will produce a mass spectrum of ions as a function of m/q. Since the number of ions leaving the mass analyzer 120 may be quite small at a particular instant, amplification may be necessary to detect a signal.

FIG. 2A is a pictorial layout of an exemplary triple quadrupole mass spectrometer 200. The first ($Q_1$) and third ($Q_3$) quadrupoles serve as mass filters, whereas the second quadrupole ($Q_2$) acts as a cell for collision-induced dissociation.

A quadrupole mass analyzer, such as $Q_1$, $Q_2$, and $Q_3$ has four cylindrical rods arranged parallel to each other. Ions are separated in a quadrupole based on the stability of their trajectories in the oscillating electric fields that are applied to the rods. Each opposing rod pair is connected together electrically, and a radio frequency (RF) voltage is applied between one pair of rods and the other pair of rods. A direct current voltage is superimposed on the RF voltage. Ions travel down the quadrupole between the rods. Only ions of a certain mass-to-charge ratio reach the detector for a given ratio of voltages; other ions have unstable trajectories and collide with the rods. As a result, selection of an ion with a particular m/q ratio continues traveling through the quadrupole.

FIG. 2B illustrates the stages of ion travel through the quadrupoles of a mass analyzer region of mass spectrometer 200. Ionized material from the ionization source is directed through an opening into the frontend section of a mass analyzer into the first quadrupole $Q_1$. The $Q_1$ electric field is established for ions of a particular mass-to-charge ratio or a range of ratios, such that ions having other mass-to-charge ratios will collide with the quadrupole interior surface. The second quadrupole $Q_2$ is configured to fragment the ions received from $Q_1$. A collision gas, such as $N_2$ or Ar collides with the ions, imparting sufficient kinetic energy to break those ions and form ion fragments. The fragmented ions continue to the third quadrupole $Q_3$ for further separation before reaching the detector region.

FIGS. 2A-2B illustrate just one or two ionization sources, electron source ionization (ESI) and APCI. However, several other ionization techniques are available, as discussed above and herein after.

Figure 3:
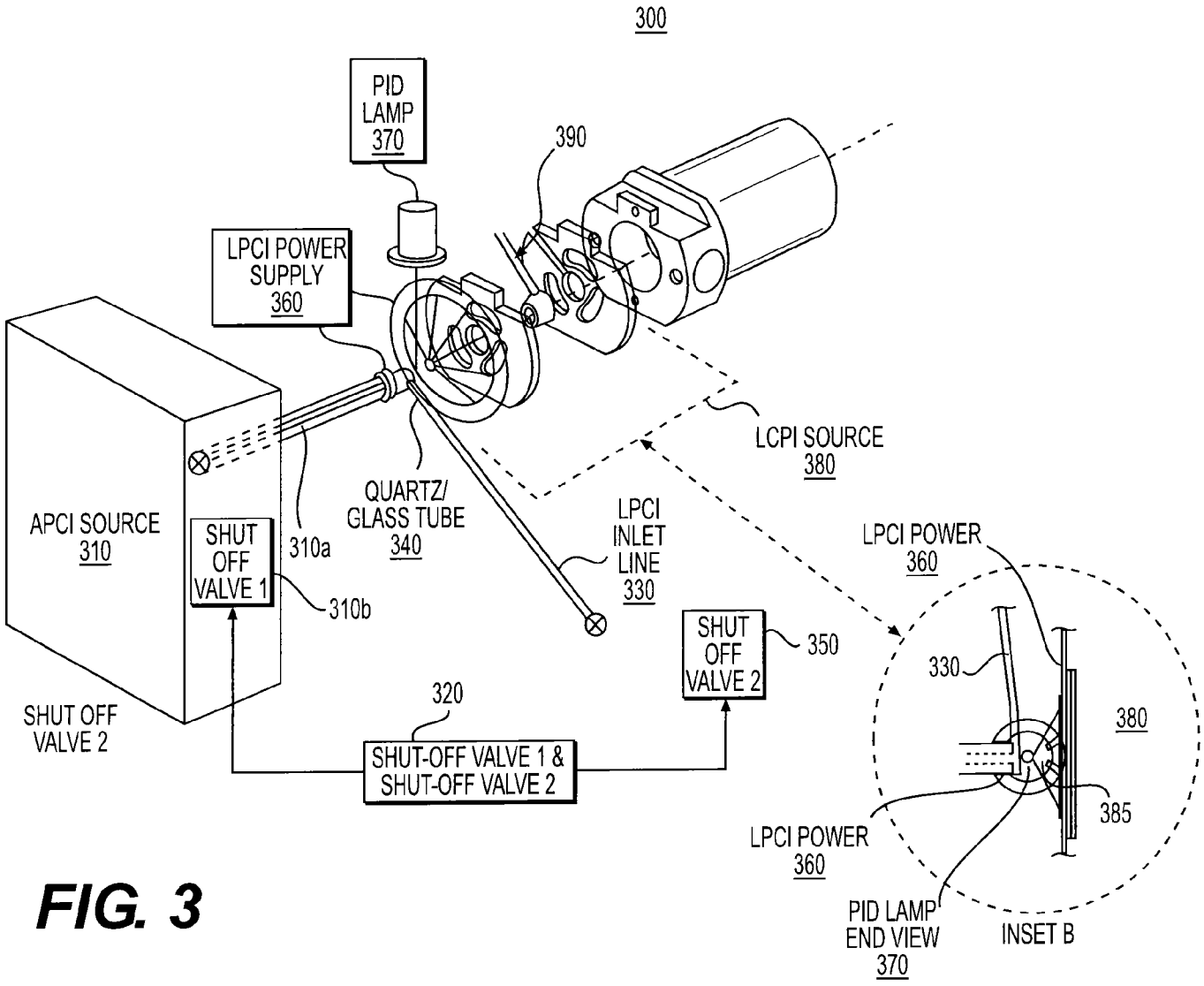
FIG. 3 is an illustration of an exemplary multiple-ionization source system of a mass spectrometer according to an embodiment.

FIG. 3 illustrates an exemplary multiple-ionization source system 300 of a mass spectrometer, such as a triple quadrupole mass spectrometer, wherein multiple ionization sources are interconnected. A single ionization source is selected at a particular instant in time, via a combination of switches, valves, and processor circuitry, which works in conjunction with a connected mass analyzer and detector (not illustrated in FIG. 3). The components illustrated in Inset A are configured to connect with a mass analyzer.

An APCI source 310 is illustrated in FIG. 3. APCI source 310 is commonly used with liquid chromatography (LC), wherein a liquid carrier is vaporized together with ambient air. APCI source 310 can also be used for analyzing ambient air. The ions produced from APCI source 310 are forced through an APCI line 310*a* via an electric field, which is ultimately connected to a mass analyzer. APCI source 310 is also configured with a shut-off valve 310*b*, which is controlled by controller 320.

FIG. 3 also illustrates a LPCI inlet line 330, which intersects into APCI inlet line 310*a*. A quartz and/or glass tube insulator 340 is configured at the end of the APCI inlet line 310*a*, which intersects with the LPCI inlet line 330. LPCI inlet line 330 can introduce the effluent from a gas chromatograph into the ionization source or it can introduce a flow of ambient air or other gas stream for real time analysis. If a gas chromatography feed is utilized and if helium is used as a carrier gas with glow discharge, a supplemental, more easily ionized gas can be added to the flow for glow discharge. Several combinations of gases, carriers, and delivery mechanisms are contemplated by embodiments described herein. A shut-off valve 350 controls the flow of ions from the LPCI inlet line 330, via controller 320.

A LPCI power supply 360 produces an ionizing glow discharge between a cap and a skimmer for glow discharge LPCI. As a result, air molecules are ionized by the discharge to form $NO_2^+$, for example. A target substance is subsequently ionized by the $NO_2^+$.

FIG. 3 also illustrates a photoionization lamp 370 of a photoionization LPCI source, which ionizes the target substance in the low pressure gas as the gas exits the capillary and expands into a subsequent vacuum region. Direct ionization of the target substance under low pressure conditions minimizes the loss of sensitivity due to collisional deactivation of the ionized target substance. Different types of lamps can be used for selective ionization of a sample flow. A repeller 390 is also illustrated, which forces and funnels the ions in a desired direction.

An expanded view of a LPCI source interconnection region 380 in FIG. 3 illustrates components that interconnect the atmospheric source and the low pressure sources with a mass analyzer. Inset B illustrates another view of LPCI source interconnection region 380. When the mass spectrometer 300 goes into a low pressure mode, a valve closes off the APCI source region. Valve 350 is opened to allow sample gas from a low pressure source to enter the LPCI source interconnection region 380 at a metered rate, via metering equipment. The pressure can range from 0.5 to 10 Torr. A common range is 1-3 Torr for ionization to take place. The LPCI inlet line 330 can bring sample gas in directly or it can have a valve to select from one or more radioactive sources or other source lines for analysis. In any case, the sample gas enters into the LPCI source interconnection region 380.

With reference to Inset B of FIG. 3, a skimmer 385 is configured in the vicinity of photoionization lamp 370. The skimmer 385 contains a small opening in front of the photoionization lamp 370, such that primarily ionized particles enter the opening and the non-ionized particles are pulled away, i.e., skimmed away from the opening via a vacuum pump. This keeps non-ionized particles from entering into a region towards the mass analyzer. The photoionization lamp 370 points at the position in which gas comes from the LPCI inlet line 330. Photoionization lamp 370 has a small beam, e.g. a one millimeter beam of UV light that needs to hit the gas just as it comes out from the LPCI inlet line 330.

The ionized particles expand after entering through the opening in the skimmer 385. Repeller 390 is configured on the backside of a source. It includes a flat plate which can push the ions out of the ionized area. In other embodiments, the repeller 390 can suck the ions down through the repeller 390 into a conical region to help focus the ions and squeeze them together into the mass analyzer.

Figure 4:
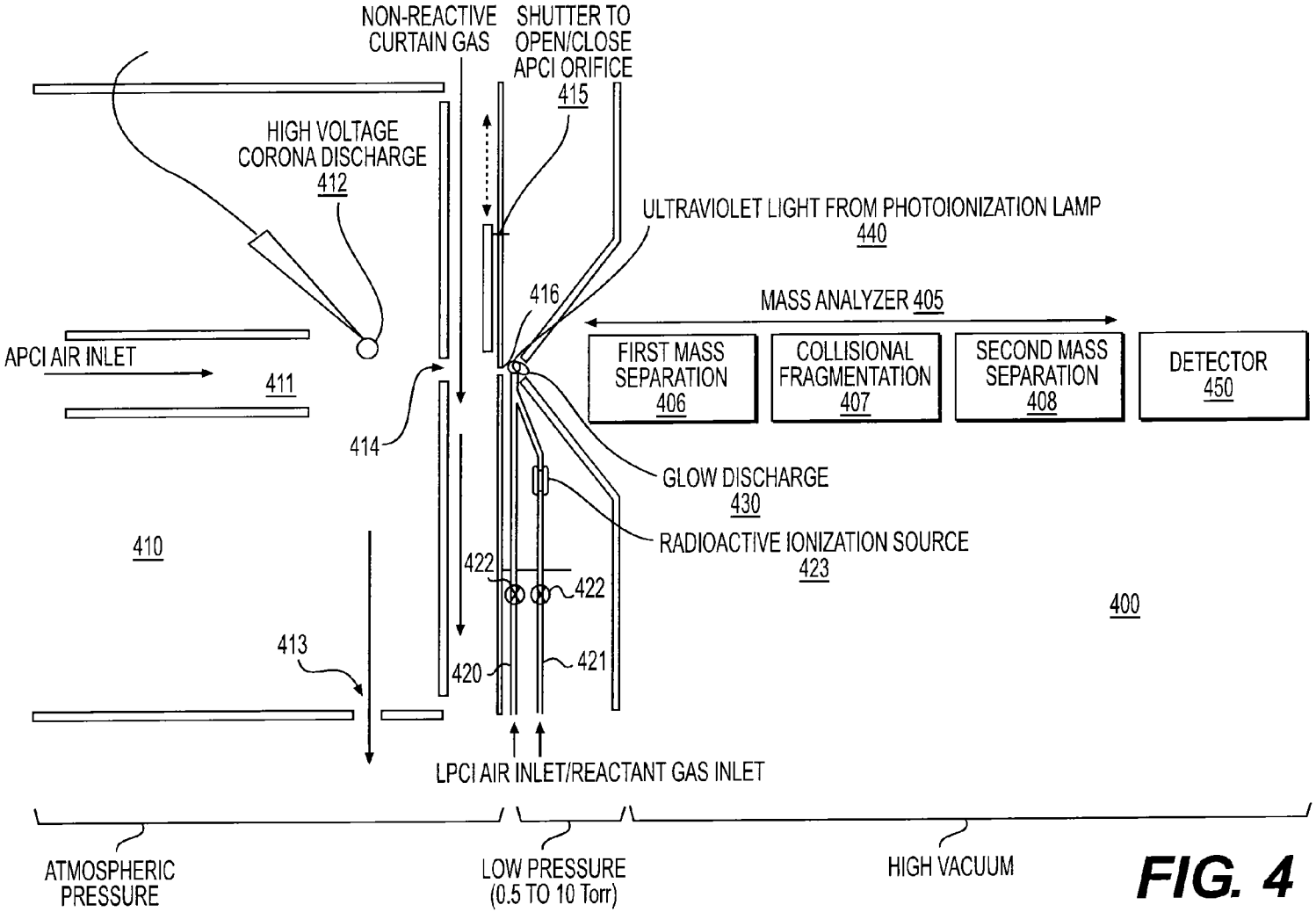
FIGS. 4-5 are exemplary detailed views of a mass spectrometer according to an embodiment.

FIG. 4 is an exemplary detailed view of a first embodiment of a mass spectrometer 400, which illustrates multiple ionization sources configured with and connected to a jointly-used mass analyzer 405. An APCI source 410 is illustrated with an APCI air inlet 411, such as high velocity ambient air. The air is blown across a high voltage corona discharge 412 to become ionized. Inlet air that is not ionized is pulled from the APCI source 410 through an outlet opening 413, as illustrated by the downward arrow. The ionized particles exit the APCI source 410 through an ion opening 414 across a non-reactive curtain gas region towards the mass analyzer 405. An example of a non-reactive curtain gas is nitrogen gas. A shutter 415 is configured to open and close an APCI orifice 416. This region of the mass spectrometer 400 operates at atmospheric pressure.

Multiple LPCI sources are connected to and work in conjunction with the mass analyzer 405. The LPCI sources operate within a low pressure range of approximately 0.5 to 10 Torr. A LPCI air inlet line 420 and a reactant gas inlet line 421 are joined to provide ions for subsequent delivery to the mass analyzer 405. Shut-off valves 422 of the air inlet line 420 and the reactant gas inlet line 421 are controlled via a controller, such as controller 320.

A radioactive ionization source 423 can be included for ionization of the inlet air and/or the reactant gas. A radioactive source can either ionize the target directly from air inlet line 420 or it can ionize a reactive gas from reactant gas inlet line 421. In the latter case, the ionized reactant gas can be mixed with sample air from air inlet line 420 to ionize the target substances in the sample air for subsequent analysis. An example of a radioactive ionization source 423 includes nickel-63, which gives off beta emission and some alpha emission. Another example of a radioactive ionization source 423 is americium, which emits alpha particles.

A glow discharge LPCI source 430 is also illustrated in FIG. 4. A LPCI power supply, such as illustrated in FIG. 3 produces an ionizing glow discharge to form ionized air molecules which subsequently ionize a sample flow. A photoionization lamp provides ultraviolet light to form ions from a photoionization LPCI source 440. The glow discharge LPCI source 430 and the photoionization LPCI source 440 reside near the opening of the LPCI air inlet line 420 and the reactant gas inlet line 421.

Valves to the low pressure ionization region are usually closed when the atmospheric pressure region is operating. However, it is possible to use the LPCI glow discharge 430 and the LPCI photoionization 440 with the APCI ionization simultaneously in tandem. In addition, an ionized reactant gas from the radioactive ionization source 423 can be added to the APCI ions that enter the low pressure region.

The mass analyzer 405 includes a triple quadrupole of a first mass separation unit 406, a collisional fragmentation unit 407, and a second mass separation unit 408. Resulting ions from the mass analyzer 405 are delivered to a detector 450. The mass analyzer 405 and detector 450 operate within a high vacuum. Other mass analyzers, such as time of flight and toroidal ion traps may be substituted for one of the quadrupole mass analyzers.

Figure 5:
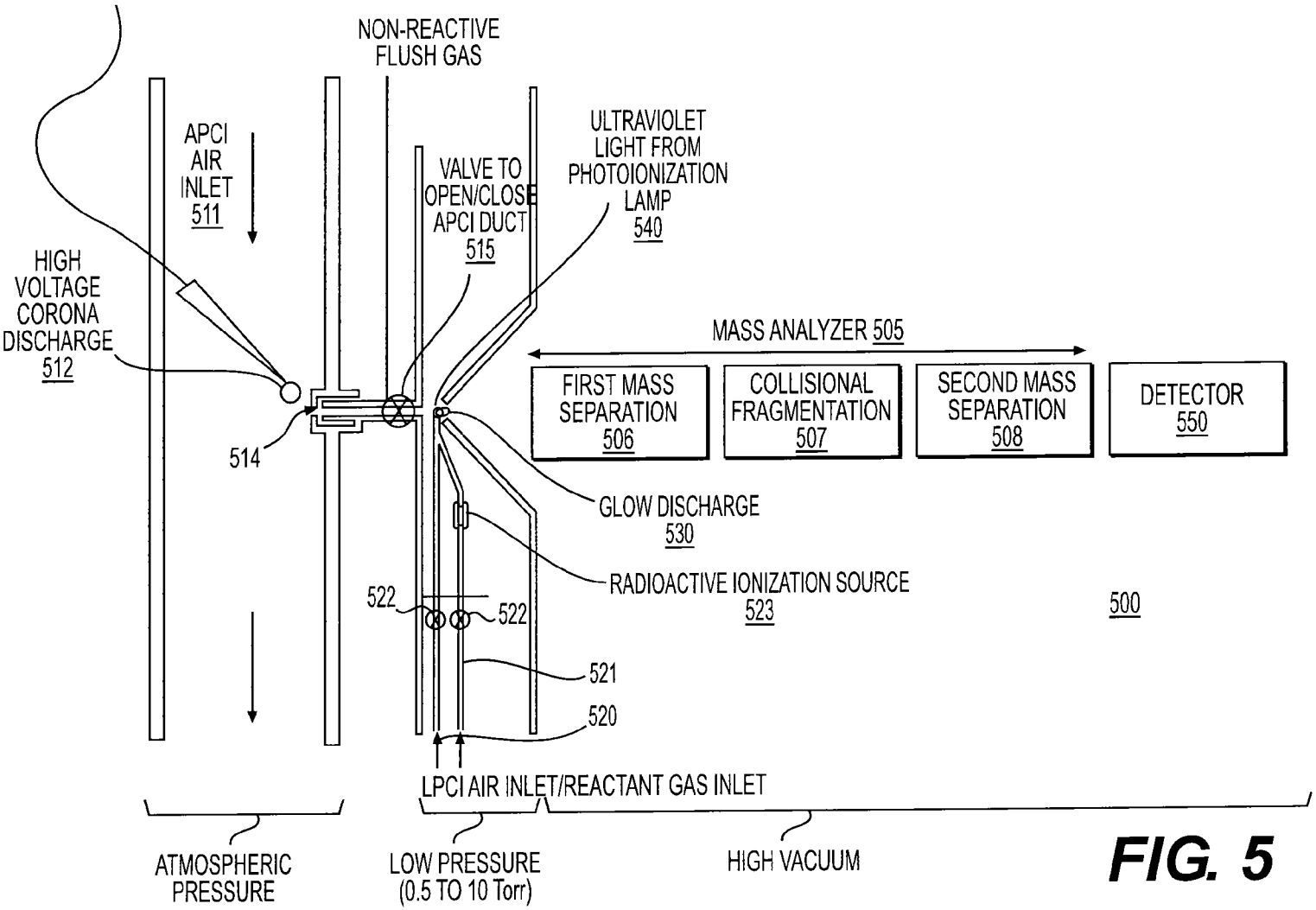

FIG. 5 is an exemplary detailed view of a second embodiment of a mass spectrometer 500, which illustrates multiple ionization sources configured with and connected to a jointly-used mass analyzer 505. An APCI source includes an APCI air inlet 511, such as ambient air. The air is blown across a high voltage corona discharge 512 to become ionized. Inlet air that is not ionized is pulled downward and removed from the APCI source region. The ion particles exit the APCI air inlet 511 through an ion opening 514 to the mass analyzer 505. A valve 515 is configured to open and close the APCI air inlet duct. A non-reactive flush gas flows around the duct leading into valve 515 and out of ion opening 514, preventing nonionized material from entering ion opening 514. This region of the mass spectrometer 500 operates at atmospheric pressure. Valves that would allow gas flow directly into a low pressure ionization region, bypassing the atmospheric pressure region are usually closed when the atmospheric pressure region is operating.

Multiple LPCI sources are connected to and work in conjunction with the mass analyzer 505. The LPCI sources operate within a low pressure range of approximately 0.5 to 10 Torr. A LPCI air inlet line 520 and a reactant gas inlet line 521 are joined to provide ions for subsequent delivery to the mass analyzer 505. Shut-off valves 522 of the air inlet line 520 and the reactant gas inlet line 521 are controlled via a controller, such as controller 320.

A radioactive ionization source 523 can be included for ionization of the inlet air and/or the reactant gas. An example of a radioactive ionization source 523 includes nickel-63, which gives off beta emission and some alpha emission. Another example of a radioactive ionization source 523 is americium-241, which emits alpha particles.

A glow discharge LPCI source 530 is also illustrated in FIG. 5. A LPCI power supply, such as illustrated in FIG. 3 produces an ionizing glow discharge to form ionized air molecules which subsequently ionize a sample flow. A photoionization lamp provides ultraviolet light to form ions from a photoionization LPCI source 540. The glow discharge LPCI source 530 and the photoionization LPCI source 540 reside near the opening of the LPCI air inlet line 520 and the reactant gas inlet line 521 for subsequent delivery to the mass analyzer 505.

The mass analyzer 505 includes a triple quadrupole of a first mass separation unit 506, a collisional fragmentation unit 507, and a second mass separation unit 508. Resulting ions from the mass analyzer 505 are delivered to a detector 550. The mass analyzer 505 and detector 550 operate within a high vacuum.

An embodiment of a mass spectrometer includes an atmospheric-pressure chemical ionization (APCI) source, and one or more low-pressure chemical ionization (LPCI) sources. The mass spectrometer also includes a mass analyzer configured to separate ions of a sample flow from the APCI source and the one or more LPCI sources, and a detector configured to identify and quantify the received separated ions. The mass spectrometer also includes a plurality of valves configured to open and close associated input lines to the APCI source and the one or more LPCI sources, via a computer-implemented controller, and configured to maintain a vacuum environment of the mass spectrometer during the opening and closing.

The mass spectrometer can also include a photoionization source configured to emit ultraviolet (UV) light onto a source gas delivered from one of the LPCI sources, and configured to ionize a portion of the source gas. The mass spectrometer can also include a glow discharge source configured to ionize air molecules for subsequent ionization of a source gas delivered from one of the LPCI sources. The mass spectrometer can also include a LPCI source interconnection region configured to interconnect input lines from the APCI source and the one or more LPCI sources to the mass analyzer. The LPCI source interconnection region can operate in a low pressure range of approximately 0.5 Torr to 10 Torr. The mass spectrometer can include a triple quadrupole mass spectrometer.

The mass spectrometer can also include one or more LPCI radioactive ionization sources. The APCI source can include a high voltage corona discharge ionization device. The mass spectrometer can also include one of a valve or a shutter configured to close the APCI source when the mass spectrometer is operating in a LPCI source mode. The mass spectrometer can be configured to operate as a gas chromatography or a liquid chromatography back-end system.

Figure 6:
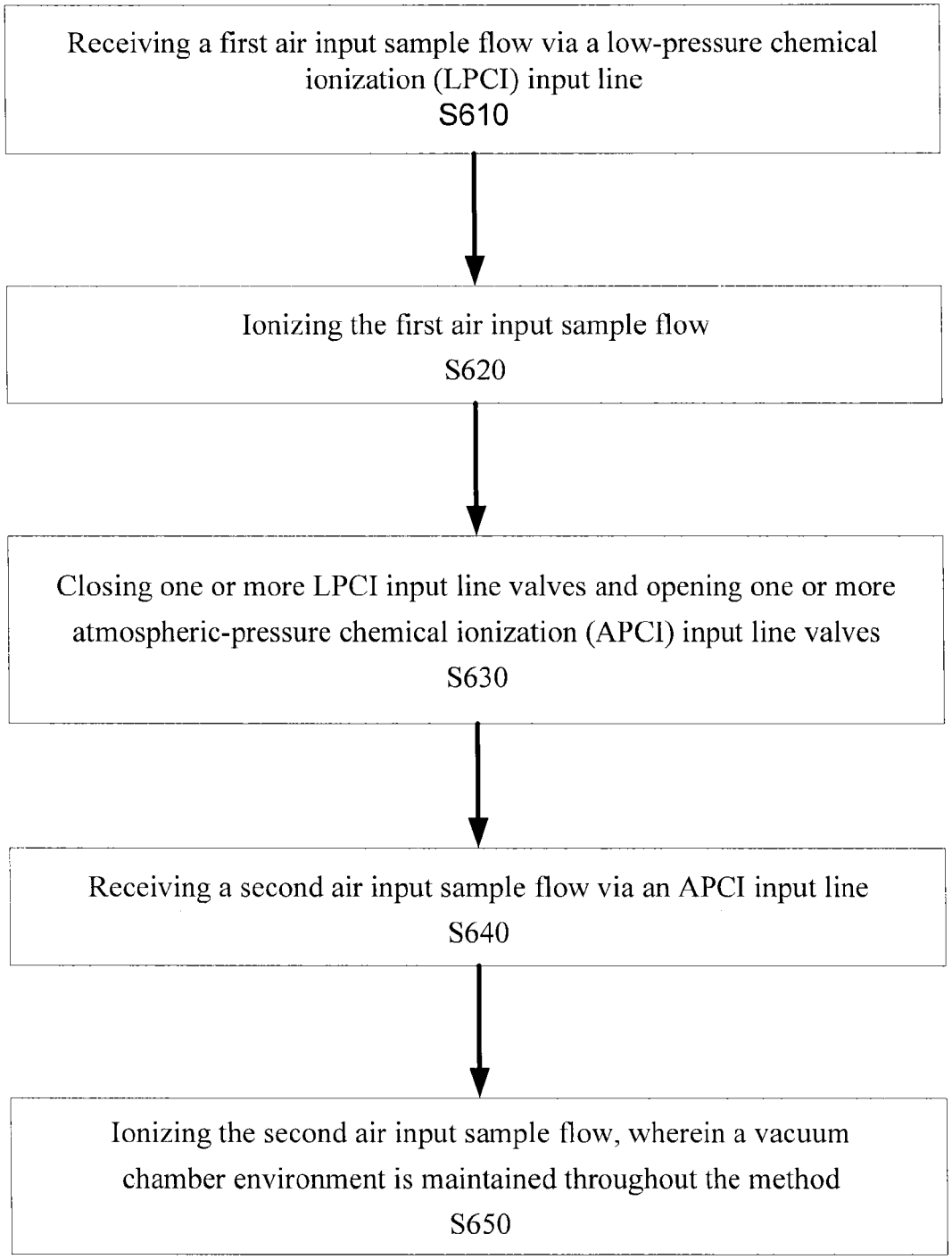
FIG. 6 is an exemplary flowchart for a method of chemically analyzing a sample flow according to an embodiment.

FIG. 6 is an exemplary flow chart for a method 600 of chemically analyzing a sample flow. Method 600 includes receiving a first air input sample flow via a LPCI input line in step S610. The first air input sample flow is ionized in step S620. Ionizing the first air input sample flow can include one of a photoionization or a glow discharge ionization, or it can include a radioactive source ionization. One or more LPCI input line valves are closed and one or more APCI input line valves are opened in step S630. A second air input sample flow is received via an APCI input line in step S640. Ionizing the second air input sample flow can include a high voltage corona discharge ionization. The second air input sample flow is ionized in step S650, wherein a vacuum chamber environment is maintained throughout method 600. Method 600 can also include directing the first and second ionized air input sample flows to a mass analyzer and a detector of a mass spectrometer.

If the instrument is not receiving its sample flow from a separation instrument, such as a gas chromatograph, the instrument can be performing ambient air analysis. Different target substances may require different ionization mechanisms to provide suitable ions for detection and analysis. Therefore, the computing device can step through different ionization modes as it cycles through the list of target substances. The same ambient air can enter through various inlets and ionizers in sequence to allow the near real-time monitoring of a wide range of target substances.

Another embodiment of a mass spectrometer includes an APCI source input line, a LPCI sample flow air inlet line, and a LPCI reactant gas inlet line. The mass spectrometer also includes a glow discharge LPCI source, a photoionization LPCI source, a mass analyzer, and a detector. The mass spectrometer also includes a plurality of computer-actuated valves configured to open and close the APCI source input line, the LPCI sample flow air inlet line, and the LPCI reactant gas inlet line while maintaining a vacuum environment of the mass spectrometer during the opening and closing.

The mass spectrometer can also include a LPCI interconnection region configured to channel ionized sample flows from an APCI source and a LPCI source to the mass analyzer and the detector. The mass spectrometer can also include a LPCI radioactive ionization source. The mass spectrometer can be a triple quadrupole mass spectrometer. The mass spectrometer can be configured to operate as a gas chromatography or a liquid chromatography back-end system.

A hardware description of a computing device including one or more processors, databases, and/or servers used in conjunction with associated circuitry is included for embodiments described herein, such as controller 320 illustrated in FIG. 3. The associated circuitry represents hardware and software components, whereby the circuitry elements of the embodiments noted above are programmed. This programming in hardware and software components constitutes algorithmic instructions to carry out the various functions and acts noted above. The computing device includes a controller processing unit (CPU) which performs the processes described above. The process data and instructions may be stored in a memory unit. These processes and instructions may also be stored on a storage medium disk such as a hard disc drive (HDD) or portable storage medium or may be stored remotely. Further, the claimed embodiments are not limited by the form of the computer-readable media on which the instructions of the processes are stored. For example, the instructions may be stored on CDs, DVDs, in FLASH memory, RAM, ROM, PROM, EPROM, EEPROM, hard disk or any other information processing device with which the computing device communicates, such as a server or computer.

Embodiments described herein provide systems and methods in which any one of several ionization sources can be computer-selected to analyze a wide range of compounds in a short period of time. A few seconds of analysis by a first ionization source could be followed by a few seconds of analysis by a second ionization source, and so forth, via computer switching of valves. Mass separation by molecular weight could include sorting for a fraction of a second on each molecular weight of interest in the first quadrupole. After passing through a collision quadrupole, additional sorting in the last quadrupole provides the mass amounts of various resulting daughter ions.

Embodiments described herein provide a broad spectrum of mass spectrometry results in a range of a few parts per trillion in many different fields for real-time monitoring of chemicals in an environment. Embodiments can also be used with a front-end gas chromatograph or liquid chromatograph.

Real-time mode of ambient air can be widely used for security purposes, as an example. Results of a chemical plume can be detected within a five to fifty-mile radius. The chemical plume could be "followed" to locate the source, such as a drug origination point. Air could also be pulled from a container or from a tunnel vent for testing to detect a target substance at the location.

Embodiments can also be applied to monitoring and controlling food processing. For example, certain bacterial infections produce specific chemical emissions that can be chemically identified. Those foods identified as spoiled can be diverted. Mites can also infect oats, and those mites emit certain chemicals or groups of chemicals that can be detected and the contaminated oats can be subsequently diverted.

Embodiments can also be applied to the medical industry. Certain cancers and bacterial infections can be detected from chemical analysis from a breathalyzer sample, for example to identify a responsible microbe in near real time.

While the invention has been described in conjunction with the specific exemplary embodiments thereof, it is evident that many alternatives, modifications, and variations will be apparent to those skilled in the art. Accordingly, exemplary embodiments as set forth herein are intended to be illustrative, not limiting. There are changes that can be made without departing from the spirit and scope of the invention.

The invention claimed is:

1. A mass spectrometer, comprising:

an atmospheric-pressure chemical ionization (APCI) source;

one or more low-pressure chemical ionization (LPCI) sources;

a photoionization lamp configured to ionize a target substance in a low pressure gas as the low pressure gas exits a capillary and expands into a subsequent vacuum environment;

a mass analyzer configured to separate ions of a sample flow from the APCI source and the one or more LPCI sources;

a detector configured to identify and quantify the received separated ions; and a plurality of valves configured to open and close associated input lines to the APCI source and the one or more LPCI sources, via a controller, and configured to maintain the vacuum environment of the mass spectrometer during the opening and closing.

2. The mass spectrometer of claim 1, wherein the photoionization lamp emits ultraviolet (UV) light onto the low pressure gas delivered from one of the LPCI sources, and configured to ionize the target substance of the low pressure gas.

3. The mass spectrometer of claim 1, further comprising:

a glow discharge source configured to ionize air molecules for subsequent ionization of a source gas delivered from one of the LPCI sources.

4. The mass spectrometer of claim 1, further comprising:

a LPCI source interconnection region configured to interconnect input lines from the APCI source and the one or more LPCI sources to the mass analyzer.

5. The mass spectrometer of claim 4, wherein the LPCI source interconnection region operates in a low pressure range of approximately 0.5 Torr to 10 Torr.

6. The mass spectrometer of claim 1, wherein the mass spectrometer comprises a triple quadrupole mass spectrometer.

7. The mass spectrometer of claim 1, further comprising:

one or more LPCI radioactive ionization sources.

8. The mass spectrometer of claim 1, wherein the APCI source comprises a high voltage corona discharge ionization device.

9. The mass spectrometer of claim 1, further comprising one of a valve or a shutter configured to close the APCI source when the mass spectrometer is operating in a LPCI source mode.

10. The mass spectrometer of claim 1, wherein the mass spectrometer is configured to operate as a gas chromatography or a liquid chromatography back-end system.

11. A method of chemically analyzing a sample flow, the method comprising:

receiving a first air input sample flow via a low-pressure chemical ionization (LPCI) input line;

ionizing the first air input sample flow that is a low pressure gas as the low pressure gas exits a capillary and expands into a subsequent vacuum chamber environment;

closing one or more LPCI input line valves and opening one or more atmospheric-pressure chemical ionization (APCI) input line valves;

receiving a second air input sample flow via an APCI input line; and ionizing the second air input sample flow, wherein the vacuum chamber environment is maintained throughout the method.

12. The method of claim 11, wherein the ionizing the first air input sample flow comprises one of a photoionization or a glow discharge ionization.

13. The method of claim 11, further comprising:

directing the first and second ionized air input sample flows to a mass analyzer and a detector of a mass spectrometer.

14. The method of claim 11, wherein the ionizing the first air input sample flow comprises a radioactive source ionization.

15. The method of claim 11, wherein the ionizing the second air input sample flow comprises a high voltage corona discharge ionization.

16. A mass spectrometer, comprising:

an atmospheric-pressure chemical ionization (APCI) source input line;

a low-pressure chemical ionization (LPCI) sample flow air inlet line;

a LPCI reactant gas inlet line;

a glow discharge LPCI source;

a photoionization LPCI source configured to ionize a target substance in a low pressure gas as the low pressure gas exits a capillary and expands into a subsequent vacuum environment;

a mass analyzer;

a detector, and a plurality of computer-actuated valves configured to open and close the APCI source input line, the LPCI sample flow air inlet line, and the LPCI reactant gas inlet line while maintaining the vacuum environment of the mass spectrometer during the opening and closing.

17. The mass spectrometer of claim 16, further comprising:

a LPCI interconnection region configured to channel ionized sample flows from an APCI source and a LPCI source to the mass analyzer and the detector.

18. The mass spectrometer of claim 16, further comprising:

a LPCI radioactive ionization source.

19. The mass spectrometer of claim 16, wherein the mass spectrometer comprises a triple quadrupole mass spectrometer.

20. The mass spectrometer of claim 16, wherein the mass spectrometer is configured to operate as a gas chromatography or a liquid chromatography back-end system.

* * * * *